US006373178B1

(12) United States Patent
Cho et al.

(10) Patent No.: US 6,373,178 B1
(45) Date of Patent: Apr. 16, 2002

(54) ELECTRON GUN FOR COLOR CATHODE RAY TUBE

(75) Inventors: Sung Ho Cho, Taegu-kwangyok-shi; Hyun Cheol Kim, Kyongsangbuk-do; Won Hyun Kim, Kyongsangbuk-do; Gill Young Jung, Kyongsangbuk-do; Ki Bog Son, Taegu-kwangyok-shi; Tae Kyu Kim; Dong Young Kim, both of Kyongsangbuk-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/481,702

(22) Filed: Jan. 12, 2000

(30) Foreign Application Priority Data

Jan. 12, 1999 (KR) ..... 99-00581
Jun. 1, 1999 (KR) ..... 99-20039

(51) Int. Cl.[7] ..... H01J 29/80
(52) U.S. Cl. ..... 313/414; 313/412

(58) Field of Search ..... 313/412, 414, 313/428, 432, 439, 448

(56) References Cited

U.S. PATENT DOCUMENTS 4,406,970 A 9/1983 Hughes
4,599,534 A 7/1986 Shirai et al.

*Primary Examiner*—Vip Patel
(74) *Attorney, Agent, or Firm*—Birch, Stewart, Kolasch & Birch, LLP

(57) ABSTRACT

Electron gun for a color CRT having main lens forming electrodes wherein a depth from a rim portion of an anode to an electrostatic field control electrode is deeper than the depth from the rim portion of a cathode to the electrostatic field control electrode, and a DQ lens action of a center beam portion formed by the DQ lens unit being weaker than the DQ lens action of an outer electron beam portion, whereby reducing a spot diameter by enlarging a main lens diameter and correcting inconsistency between a center beam and an outer beam in the DQ lens.

11 Claims, 14 Drawing Sheets

ELECTRON GUN FOR COLOR CATHODE RAY TUBE

BACKGROUND OF THE INVENTION

1. Field of the Invention

The present invention relates to a color cathode ray tube(CRT), and more particularly, to an electron gun for a color CRT for generating electron beams.

2. Background of the Related Art

FIG. 1 illustrates a section of a first exemplary related art color CRT with an electron gun. In general, the CRT is a display for displaying a desired image by directing three electron beams 2 to a fluorescent film 3 on an inside surface of a panel 1, to make the fluorescent film 3 luminescent. The CRT is provided with an electron gun 4 for emitting the electron beams.

The first exemplary related art electron gun is provided with three independent cathodes 40, and first, second, third, fourth, fifth, and sixth electrodes 41, 42, 43, 44, 45, and 46 disposed at intervals in a tube axis direction. There is a shield cup 47 fitted to a screen side of the sixth electrode 46. Upon application of power to stem pins 5 on the electron gun 4, heaters heat the cathodes 40 causing them to emit electrons. The amount of emitted electrons is controlled by the first electrode 41, accelerated by the second electrode 42, and converged and accelerated by a pre-focus lens formed between the third, fourth, and fifth electrodes 43, 44, and 45. Then, the electron beams 2 are precisely focused onto a preset scan position by a main lens having a strong focusing power formed by a potential difference between the fifth electrode 45 and the sixth electrode 46.

The diameter of the main lens fixes a spot size of the electron beam 2. That is, if the main lens has a smaller diameter with a greater spherical aberration, the spot size of the electron beams passing through the main lens becomes greater, and if the main lens has a greater diameter with a smaller spherical aberration, a spot size of the electron beams passing through the main lens becomes smaller, relatively. The diameter of the main lens is dependent on electron beam pass through apertures formed on opposing sides of the fifth and sixth electrodes 45 and 46. If the size of the electron beam pass through apertures is large, the diameter of the main lens is the larger, and opposite to this, if the size of the electron beam pass through aperture is small, the diameter of the main lens is comparatively smaller.

Therefore, in the electron gun in the first exemplary related art CRT, the three electron beam pass through apertures (not shown) formed in opposing surfaces of the fifth and sixth electrodes 45 and 46 form a main lens proportional to the size of electron beam pass through apertures. Though the size of the electron beam pass through apertures should be formed greater for forming a greater main lens, the size is limited. Accordingly, the electron gun in the first exemplary related art CRT, which has a small main lens diameter, is mostly used in a small sized Braun tube or a Braun tube, requiring a low resolution.

FIG. 2 illustrates a perspective view of key parts of a second exemplary related art electron gun, showing the fifth and sixth electrodes provided for enlarging the main lens. (See U.S. Pat. No. 4,406,970). The second exemplary related art electron gun is a modified version of the first exemplary related art electron gun for enlarging the main lens. That is, the second exemplary related art electron gun is provided with rim portions 45*b* and 46*b* of race track forms on opposing surfaces of the fifth electrode 45 (or focus electrode) and the sixth electrode 46 (or anode electrode), recesses with recess surfaces 45*c* and 46*c* inside of the rim portions 45*b* and 46*b*, and three electron beam pass through apertures 45*a*, 46*a* in each of the recess surfaces 45*c* and 46*c*. Since the recesses 45*d* and 46*d* formed in the opposing surfaces of the electrodes act as apertures, a main lens proportional to the recesses can be obtained between the fifth electrode 45 and the sixth electrode 46, permitting use of a main lens that is comparatively greater than the first exemplary electron gun.

FIG. 3 illustrates a perspective view of key parts of a third exemplary related art electron gun, showing the fifth and sixth electrodes provided for enlarging the main lens. (See U.S. Pat. No. 4,599,534).

Referring to FIG. 3, in order to enlarge the diameter of the main lens, the third exemplary related art electron gun is provided with rim portions 45*b* and 46*b* of race track forms in opposing surfaces of the fifth electrode 45 and the sixth electrode 46 for common pass through of the three electron beams, and field control electrodes 45*e* and 46*e* of plates approx. 0.6~0.7 mm thick and fixed at locations recessed at a depth from the rim portions 45*b* and 46*b* for forming identical lens power for the electron beams 2. Each of the electric field control electrodes 45*e* and 46*e* has vertically elongated electron beam pass through apertures 45*a* and 46*a* at their centers, which have a horizontal diameter that is shorter than a vertical diameter, and half cut away vertically elongated apertures adjacent to the apertures 45*a* and 46*a* at the centers for pass through of outer electron beams. There is also a correction electrode 48 of an angle form fitted to the shield cup 47 electrically connected to the sixth electrode 46. End portions of the rim portions 45*b* and 46*b* are curved inwardly by approx. 1 mm. Thus, also in the third exemplary related art electron gun, inside portions of the rim portions 45*b* and 46*b* formed in opposing surfaces of the fifth electrode 45 and the sixth electrode 46 serve as apertures, to provide a large diameter main lens. In comparison to the second exemplary related art electron gun, the third exemplary related art electron gun can provide a uniform lens action to the three electron beams by means of the electric field control electrodes 45*e* and 46*e* formed in the fifth and sixth electrodes 45 and 46, and can correct the vertical direction strong lens action into a horizontal direction by means of the vertically elongated rim portions 45*b* and 46*b*.

FIG. 4 illustrates a perspective view of key parts of a fourth exemplary related art electron gun, similar to the second and the third examples provided for enlarging the main lens.

Referring to FIG. 4, the fourth exemplary related art electron gun is provided with rim portions 45*b* and 46*b* of race track forms in opposing surfaces of the fifth electrode 45 and the sixth electrode 46 for pass through of the three electron beams in common, with the insides of the rim portions fully opened, and electric field control electrodes 45*e* and 46*e* having rectangular electron beam pass through apertures 45*a* and 46*a* curved inwardly for the center electron beam at locations inside of opened portions 45*f* and 46*f*. Each of the rim portions 45*b* and 46*b* are curved inwardly by 1 mm for reinforcing the electrodes for preventing distortion of the diameter during fabrication.

FIG. 5 illustrates a section of a fifth exemplary related art electron gun. The fifth exemplary related art electron gun 4 is an electron gun for forming a dynamic quadrupole lens ("DQ") having a lens action against a deflection yoke. That is, the fifth electrode, a focus electrode, is divided into a 5-1 electrode 50 and a 5-2 electrode 51, and the DQ lens is provided between the 5-1 electrode 50 and the 5-2 electrode 51. The DQ lens corrects a vertical elongation of a spot of an electron beam in forming a circular spot. This electron gun is used in a Braun tube requiring a high resolution or a large sized Braun tube to prevent distortion of an image along the periphery of a screen.

FIG. 6 illustrates a perspective view of key parts of a sixth exemplary related art electron gun. The sixth exemplary related art electron gun also utilizes a DQ lens, wherein the fifth electrode is divided into a 5-1 electrode 50 and a 5-2 electrode 52, three vertically elongated electron beam pass through apertures 50*a* of key aperture forms are formed in a surface of the 5-1 electrode 50 opposing a corresponding site of the 5-2 electrode 52, an electric field control electrode 51 of a plate form having three circular electron beam pass through apertures is provided inside of the 5-1 electrode 50, three vertically elongated electron beam pass through apertures 52*a* of key aperture forms are formed in a surface of the 5-2 electrode 52 opposite to the 5-1 electrode 50, and a plate projection 53 projects from both the top and bottom of each of the electron beam pass through apertures 52*a* in a horizontal direction. The plate projection 53 on the center aperture has a height h1 that is comparatively higher than a height h2 of the plate projection 53 on the outer apertures.

Electron gun design parameters, that influence spot diameter include a magnifying power of the lens, a spatial charge repulsive force, and a spherical aberration of the main lens. However, the influence of the lens magnifying power to the spot diameter Dx is of little use as a design parameter since the voltage distance of focus, and length of the electron gun are basically fixed. In order to reduce enlargement of the spot diameter "Dst" coming from the spatial charge repulsive force, a phenomenon in which electrons in the electron beams repel and collide with one another to enlarge the spot diameter, it is favorable that an angle of advance of the electron beam (divergence angle "α") is designed to be enlarged. Opposite to spatial charge repulsive force, the spherical aberration of the main lens, denoting that an enlarged spot diameter "Dic" caused by a difference in focus of electrons passed through a radical axis of the lens and a protaxis of the lens, forms a smaller spot diameter as the divergence angle of the electron beam incident to the main lens becomes smaller. In general, the spot diameter "Dt" on a screen can be expressed with an equation, below.

$$Dt=\sqrt{(Dx+Dst)^{2+Dic^2}},$$

where, Dx represents a spot diameter by a lens magnifying power, Dst represents a spot diameter by the spatial charge repulsive force, and Dic represents a spot diameter by a difference of electrons passed through a radical axis and a protaxis, i.e., a spherical aberration. Particularly, the best method to reduce the spatial charge repulsive force and the spherical aberration at the same time is to enlarge the diameter of the main lens, to reduce spot enlargement caused by spherical aberration even if the electron beam has a great divergence angle, and to reduce the spatial charge repulsive force after the electron beam passes through the main lens.

FIGS. 7 and 8 illustrate a drawing and a graph showing a method for calculating a main lens diameter. After calculating an optimal objective distance for a fixed voltage, configuration, and focal distance, an electron beam is passed through the main lens. A graph is then plotted taking the divergence angle α and a diameter R of the electron beam as axes as shown in FIG. 9, so that a lens diameter of a particular main lens is calculated into an equivalent diameter of a circular main lens by comparison with the circular lens. FIG. 8 illustrates that a horizontal main lens diameter H is equivalent to approx. 11.5 mm, and a vertical main lens diameter V is equivalent to approx. 7.6 mm. FIG. 9 illustrates a main lens diameter vs. a spot diameter, wherein it can be known that increasing the diameter of the main lens while decreasing the spherical aberration of the main lens reduces the spot diameter. The main lens diameter can be enlarged by enlarging a physical aperture diameter of the main lens, or by designing a depth of the electric field control electrode which corrects the lens greater. However, physical enlargement of the electrode aperture diameter is limited in that a diameter of the neck portion is limited to 29.1 mm. Accordingly, a design in which a position of the electrostatic field control electrode for the fifth and sixth electrodes, main lens forming electrodes, is placed deeper has been made. However, when a depth L1 from a surface of the fifth electrode 45 opposite to the sixth electrode 46 to the electrostatic field control electrode is approx. 3 mm and a depth L2 from a surface of the sixth electrode 46 opposite to the fifth electrode 45 to the electrostatic field control electrode is greater than approx. 3.6 mm, it is impossible provide a design which satisfies the same convergences of lenses and desired astigmatisms for the three electron beams and out of beam convergence characteristics ("OCV"), which is a distance between outer beams on the screen caused by convergence of the outer beams toward a central beam. Therefore, the maximum main lens diameter obtainable from the main lens is 8.8 mm in a horizontal direction and 7.8 mm in a vertical direction as shown in TABLE 1.

TABLE 1

| | Depth of electrostatic field control lens (mm) | | Lens diameter (mm) | |
|---|---|---|---|---|
| | | | horizontal | vertical |
| No. | focus electrode | anode | diameter | diameter |
| 1 | 3.20 | 2.35 | 6.40 | 7.90 |
| 2 | 3.50 | 2.60 | 6.80 | 7.90 |
| 3 | 3.80 | 3.62 | 8.80 | 7.80 |
| 4 | 4.00 | 4.20 | 9.60 | 7.80 |

For improvement of focus to keep pace with the requirements for high resolution images and employment of a high frequency, a reduction of a horizontal spot diameter on the screen is keenly required, which in turn requires an increased main lens diameter. And, of the exemplary related art electron guns, the fifth and sixth exemplary related art electron guns show the horizontal direction diameter of the center lens being smaller by approx. 0.7 mm than the outer lenses. Therefore, in order to obtain an optimal DQ lens action, strengthening of the DQ lens action of the outer lenses is required because aspect ratios of the outer electron beams in the main lens portion after the electron beams passed through the DQ lens are higher than that of the center beam. That is, as shown in FIG. 11, in order to increase the DQ lens action, the height of the plate projection 53 on the center aperture in the 5-2 electrode 52 in the DQ lens portion should be higher than the height of the plate projection 53 on the outer apertures since the height of the plate projection on the 5-1 electrode 51 should be higher in the fifth electrode, for satisfying a horizontal direction focusing power for the spot in a periphery of the screen.

SUMMARY OF THE INVENTION

Accordingly, the present invention is directed to an electron gun for a color CRT that substantially obviates one or more of the problems due to limitations and disadvantages of the related art.

An object of the present invention is to provide an electron gun for a color CRT which can improve focus characteristics.

Another object of the present invention is to provide an electron gun for a color CRT, which can correct inconsistency between a center beam and outer beams in a DQ lens that occurs when a spot diameter on a screen is reduced by enlarging a main lens diameter.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electron gun for a color CRT includes a plurality of cathodes each for emitting an electron beam, a triode unit having a control electrode and an accelerating electrode for controlling an amount of emission of the electron beam, a pre-focus lens unit having at least two electrodes for converging the electron beam, two electrodes for forming a main lens for focusing the electron beam onto a screen, each of the two electrodes for forming a main lens having a rim portion in an opposite surface of respective main lens forming electrodes common for the three electron beams, and an electrostatic field control electrode positioned a distance from the rim portion, wherein, in the main lens forming electrodes, a depth from the rim portion of an anode to the electrostatic field control electrode is deeper than the depth from the rim portion of a cathode to the electrostatic field control electrode.

In another aspect of the present invention, there is provided an electron gun for a color CRT including a plurality of cathodes each for emitting an electron beam, a triode unit having a control electrode and an accelerating electrode for controlling an amount of emission of the electron beam, a pre-focus lens unit having at least two electrodes for converging the electron beam, two electrodes for forming a main lens for focusing the electron beam onto a screen, each of the two electrodes for forming a main lens having a cup electrode with a rim portion in an opposite surface of respective main lens forming electrode common for the three electron beams, an electrostatic field control electrode positioned a distance inside from the rim portion having three electron beam pass through apertures, and an electrode of a cap form, three of them being connected electrically, wherein, in the main lens forming electrodes, relations between a maximum horizontal diameter H, a maximum vertical diameter V, and a distance from the rim portion to the electrostatic field control electrode L for at least one of the electrodes can be expressed as follows.

$$L \geqq 4.0(V/H)+2.1.$$

In other aspect of the present invention, there is provided an electron gun for a color CRT including a plurality of cathodes each for emitting an electron beam, a triode unit having a control electrode and an accelerating electrode for controlling an amount of emission of the electron beam, a pre-focus lens unit having at least two electrodes for converging the electron beam, a DQ lens unit having at least two electrodes for removing a vertical halo from all region of a screen, two electrodes for forming a main lens for focusing the electron beam onto the screen, the main lens has a relation expressed as follows, a diameter of the main lens≧(neck diameter×0.26)+1.4, wherein a DQ lens action of a center beam portion formed by the DQ lens unit is weaker than the DQ lens action of an outer electron beam portion.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. Preferred embodiments of the present invention will be explained with reference to FIGS. 12~16.

Figure 12:
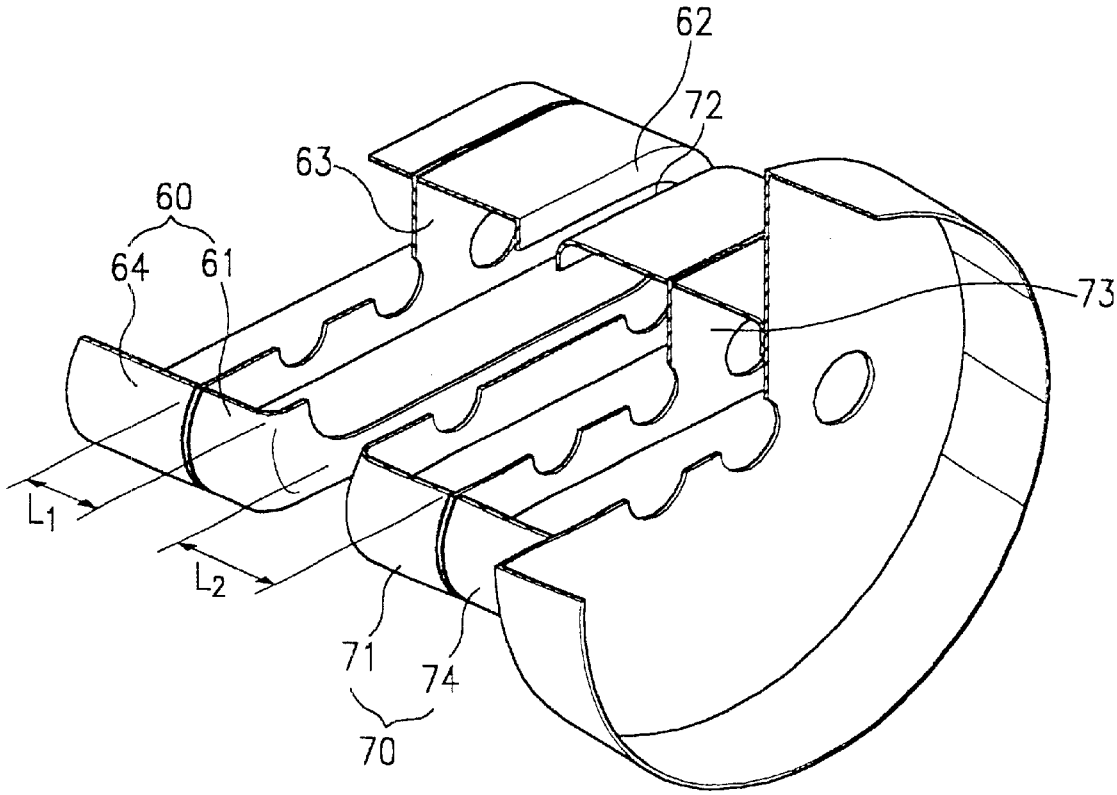
FIG. 12 illustrates a perspective view showing key parts of main lens forming electrodes in accordance with a first preferred embodiment of the present invention.

FIG. 12 illustrates a perspective view showing key parts of main lens forming electrodes in accordance with a first preferred embodiment of the present invention. As shown in FIG. 12, the first embodiment of an electron gun of the present invention includes cup formed electrodes 61, 71 each having a rim portion 62, 72 common for three electron beams, electrostatic field control electrodes 63, 73 of plate forms each having three electron beam pass through apertures, and cap formed electrodes 64, 74. The aforementioned electrodes are electrically connected by welding. The present invention suggests to set depths L1, L2 from the rim portion 62, 72 to the electrostatic field control electrode 63, 73 greater than 3.9 mm while a physical dimension of the main lens diameter is enlarged by forming the rim portion 62, 72 to have a ratio of a maximum vertical diameter to a maximum horizontal diameter to be greater 0.45, with the maximum horizontal diameter greater than 19.2 mm and a maximum vertical diameter greater than 8.7 mm, for enlarging the lens diameter. The depth L2 of the electrostatic field control electrode 73 in the sixth electrode 70 is set deeper than the depth L1 of the electrostatic electrode 63 in the focus electrode 60, and, in order to increase the aperture diameter of the rim portion, the electrode is formed thicker as a counter measure to distortion while the curved portion is eliminated.

Figure 1:
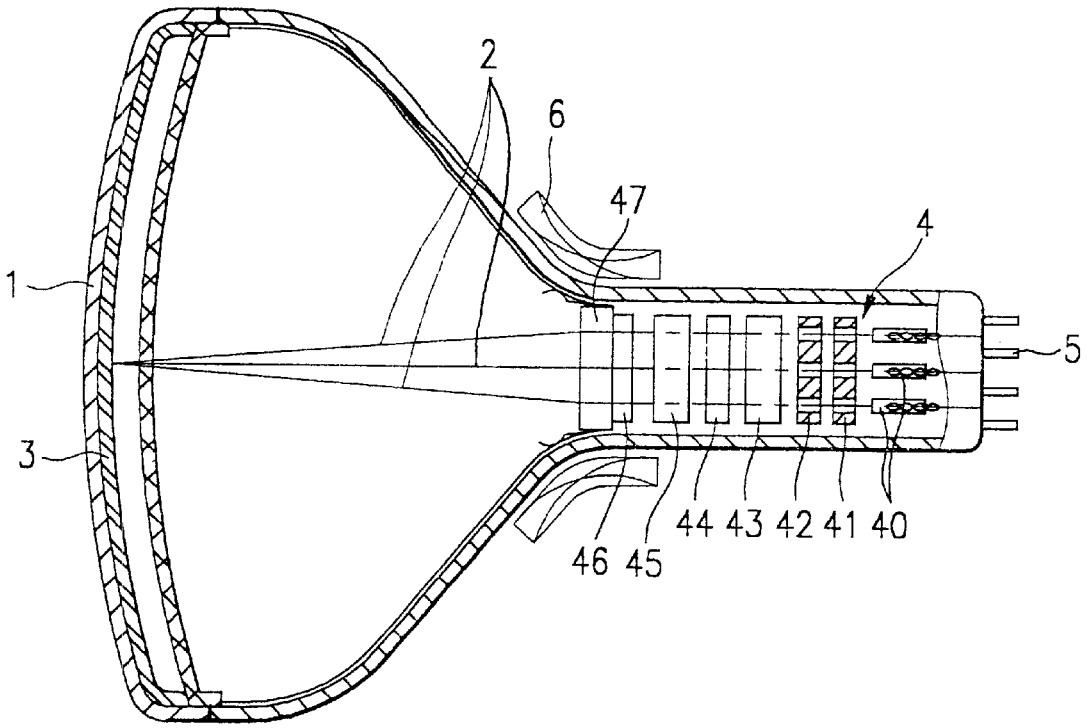
FIG. 1 Related Art
FIG. 1 illustrates a section of a first exemplary related art color CRT with an electron gun.
Figure 2:
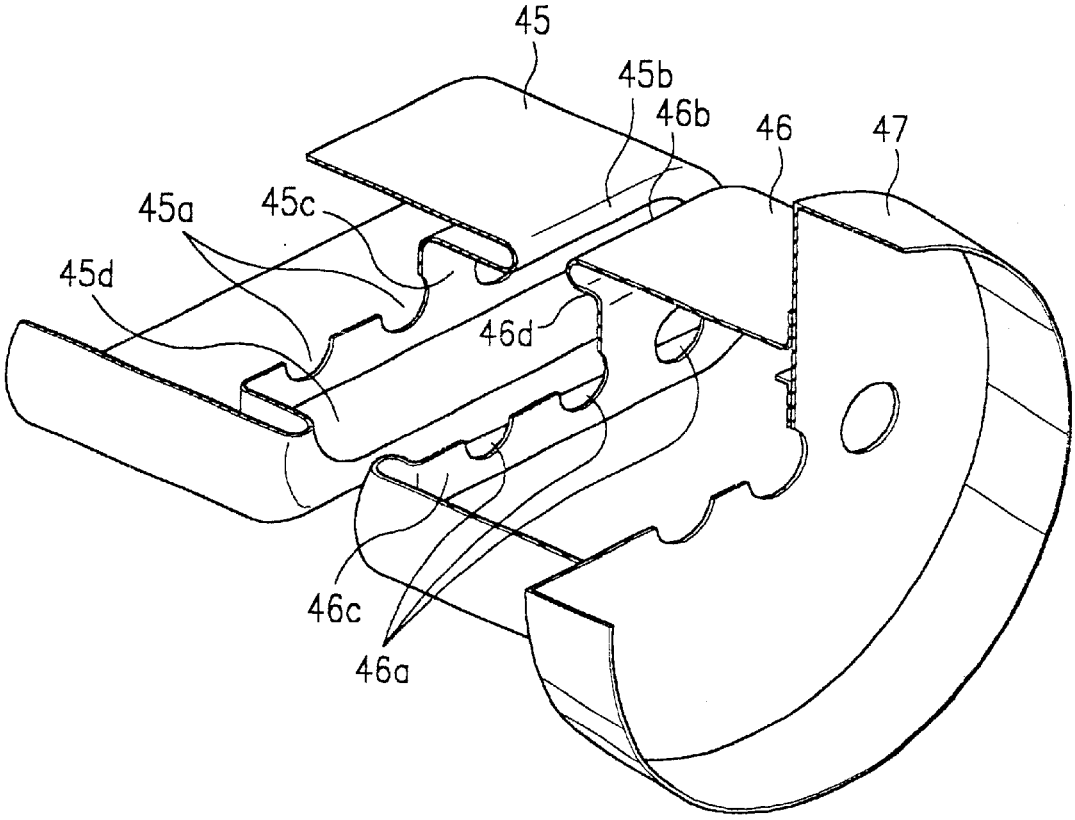
FIG.2 Related Art
FIG. 2 illustrates a perspective view of key parts of a second exemplary related art electron gun.
Figure 3:
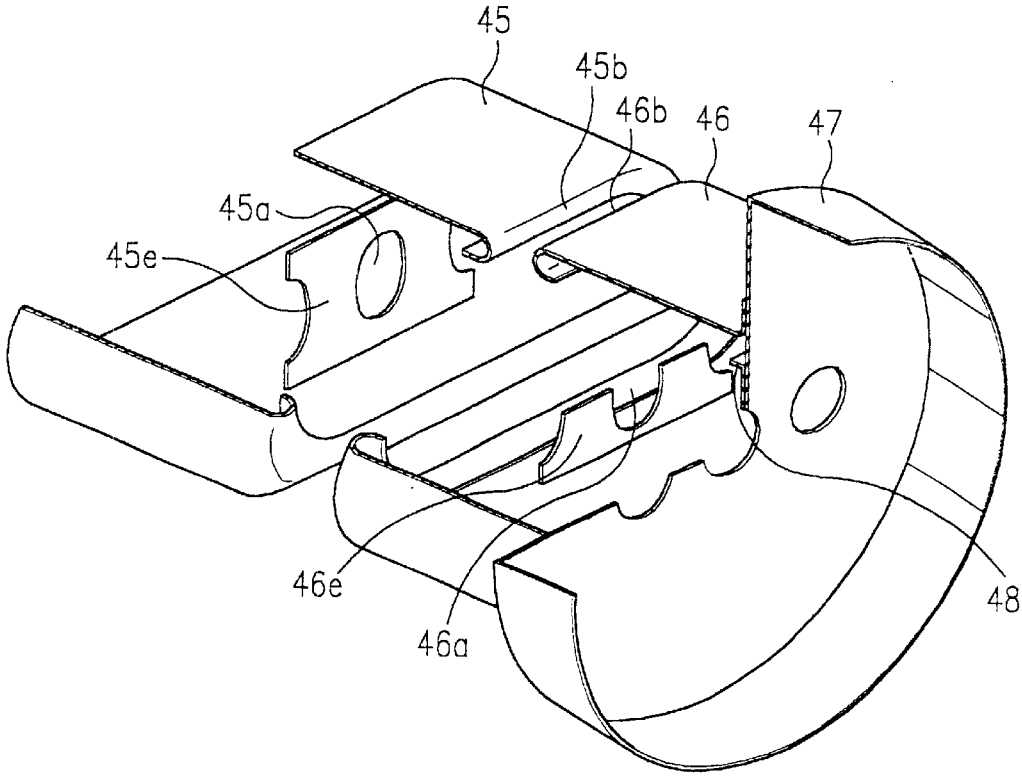
FIG.3 Related Art
FIG. 3 illustrates a perspective view of key parts of a third exemplary related art electron gun.
Figure 4:
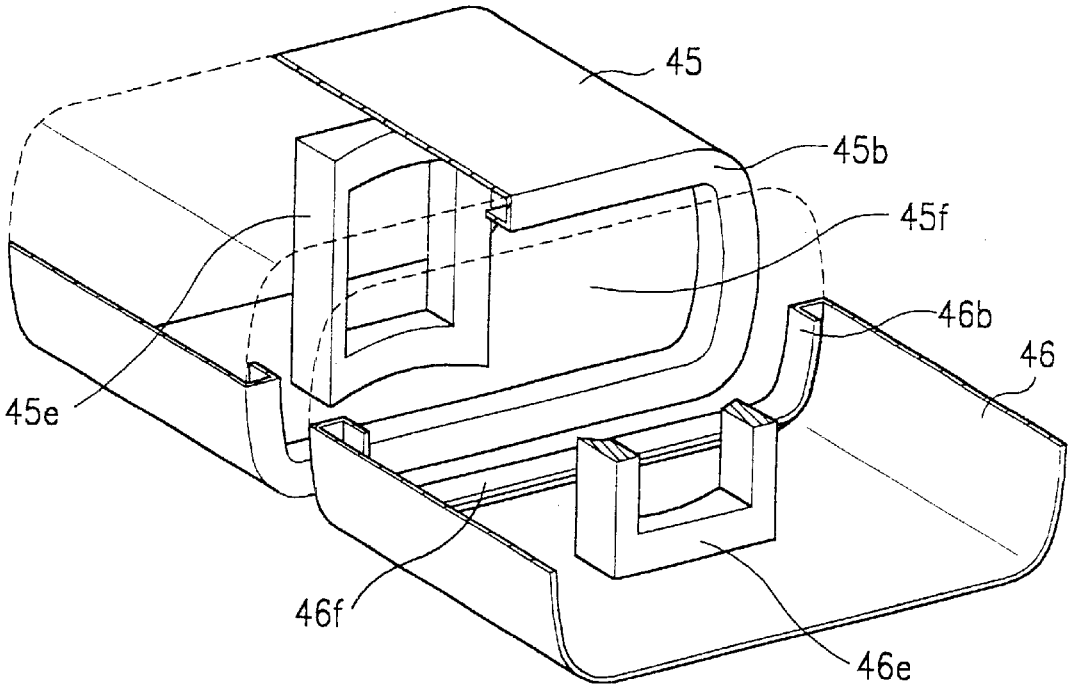
FIG.4 Related Art
FIG. 4 illustrates a perspective view of key parts of a four exemplary related art electron gun.
Figure 5:
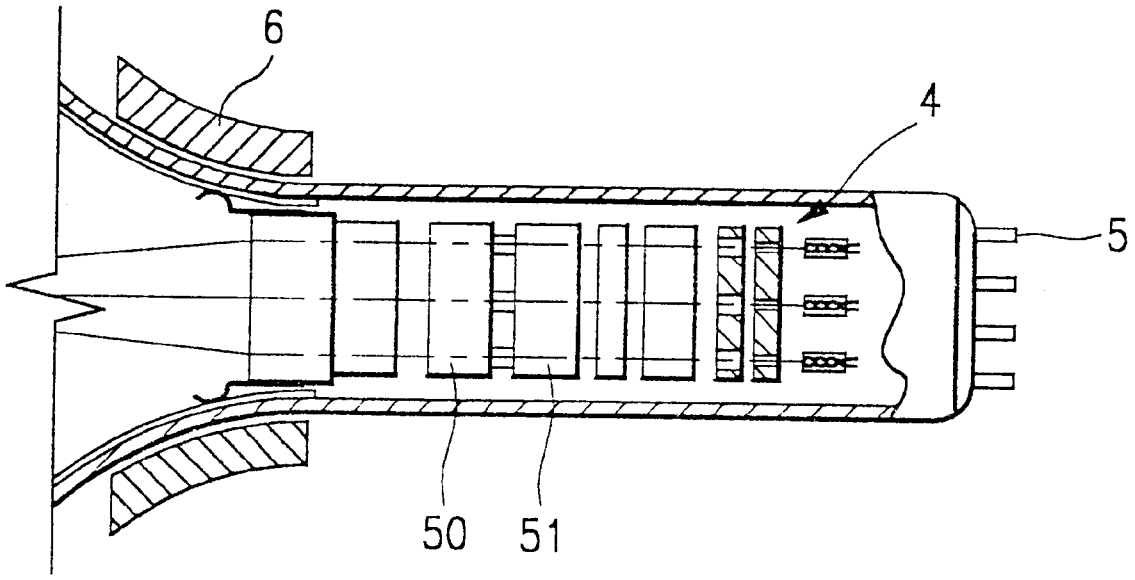
FIG.5 Related Art
FIG. 5 illustrates a perspective view of key parts of a fifth exemplary related art electron gun.
Figure 6:
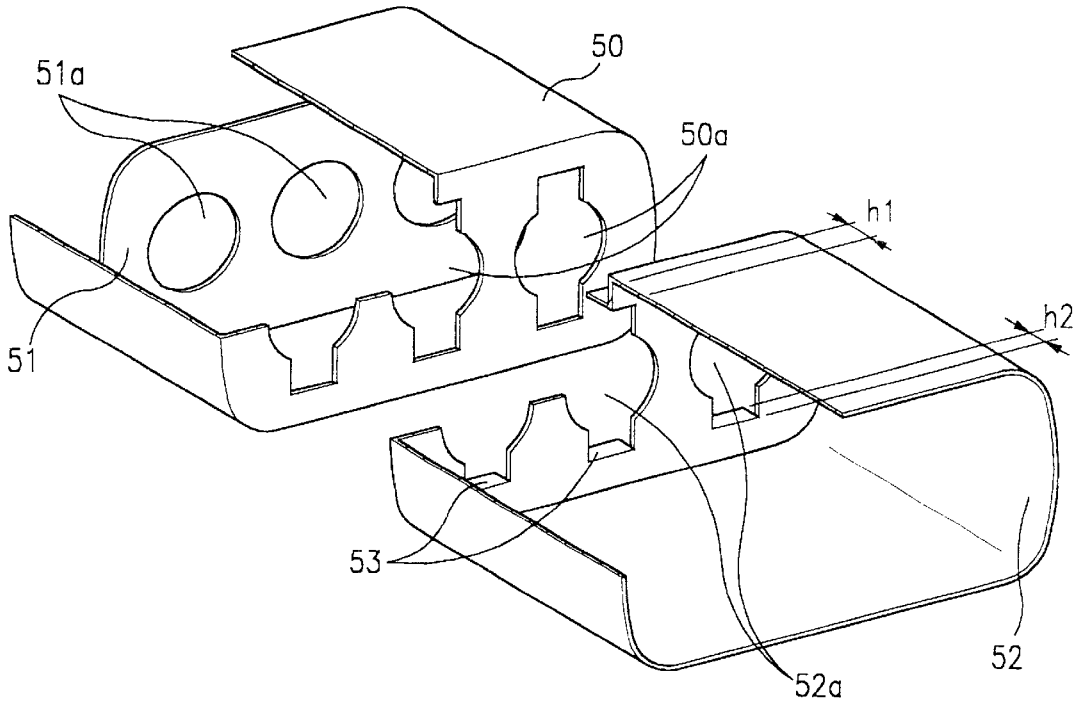
FIG.6 Related Art
FIG. 6 illustrates a perspective view of key parts of a sixth exemplary related art electron gun.
Figure 7:
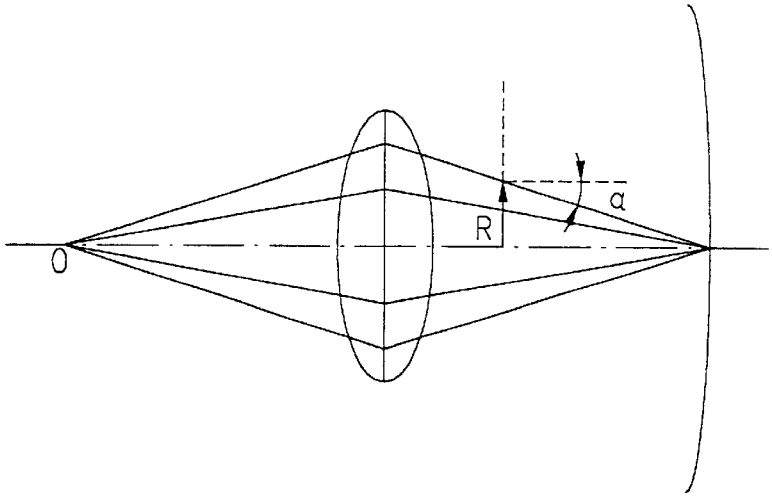
FIG.7 Related Art
FIGS. 7 and 8 illustrate a drawing and a graph showing a method for calculating a main lens diameter.
Figure 8:
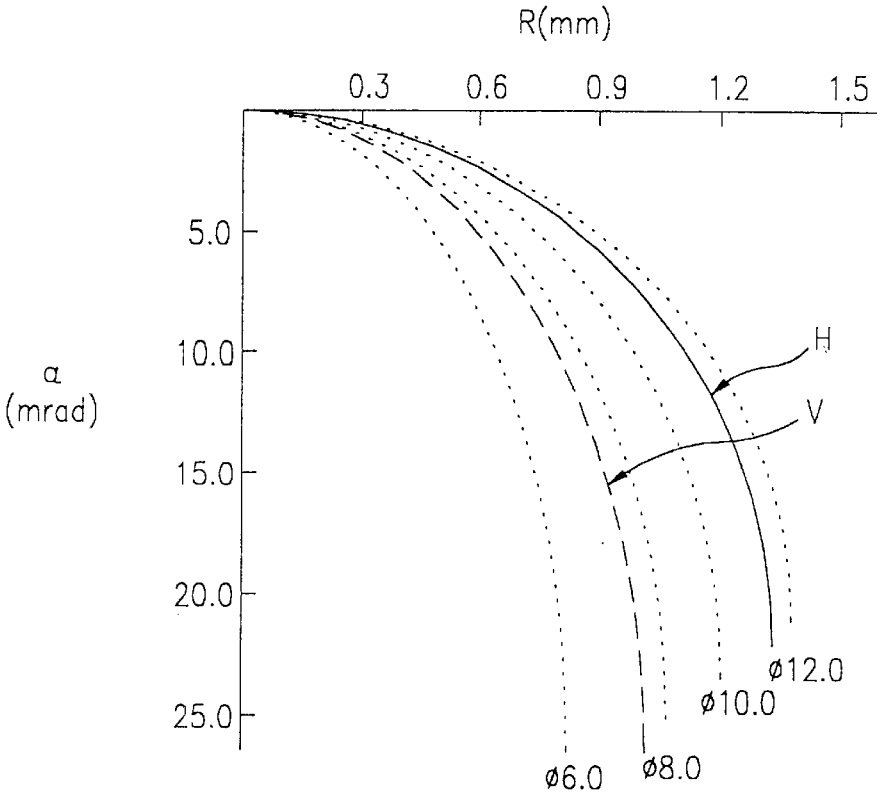
FIG.8 Related Art
Figure 9:
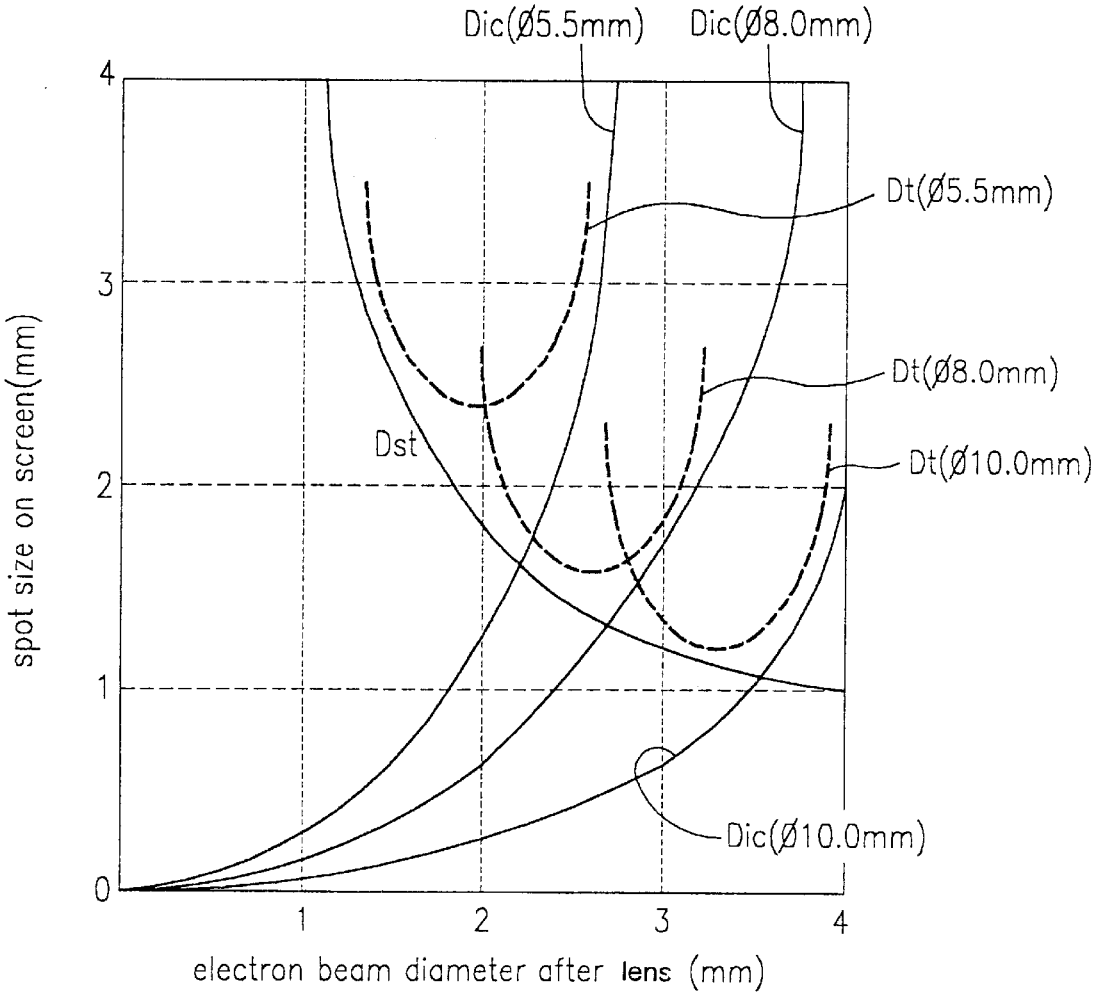
FIG.9 Related Art
FIG. 9 illustrates a main lens diameter vs. a spot diameter.

For reference, the main lens in the related art electron gun shown in FIGS. 2~4 has a ratio of the vertical diameter to the horizontal diameter of 0.42 as the vertical diameter and the horizontal diameter are approx. 8.0 mm and 19.0 mm, respectively. And, the depth of the electrostatic field control electrodes 45*e*, 46*e* is approx. 3.5~3.8 mm in the case of the focus electrode, and approx. 2.6~3.6 mm in the case of the anode, with the depth of the electrostatic field control electrode of the focus electrode formed deeper than the depth of the electrostatic field control electrode of the anode. Since the main lens forming electrodes 60, 70 of the present invention includes cup electrodes 61, 71 having rim portions 62, 72, plate formed electrostatic control electrodes 63, 73 and cap electrodes 64, 74, the present invention solves the difficulty in fabrication coming from adjusting depths L1 and L2 of the electrostatic field control electrodes in recessed forms in the main lens forming electrodes in the related art electron gun shown in FIG. 2. And, the present invention also solves variation of the depth, and distortion of the electrostatic field control electrode fitted in the main lens forming electrodes coming from a weak withstanding strength during assembly of the electron gun.

In order to compensate for a focus degradation of a red electron beam spot caused by a ratio of deep red fluorescent material giving a deep color sense higher relative to green and blue, a necessity for reducing the spot becomes still greater by enlarging a diameter of the outer main lens relative to the center main lens. According to this, in order to compensate for a difference of actions between a center beam portion and an outer beam portion of the DQ lens occurring as the diameter of outer main lens is enlarged, the present invention suggests the action of the DQ lens in the outer beam portion is formed stronger than in the center beam portion, to obtain uniform focus characteristics for the three electron beams all over the screen.

Figure 13:
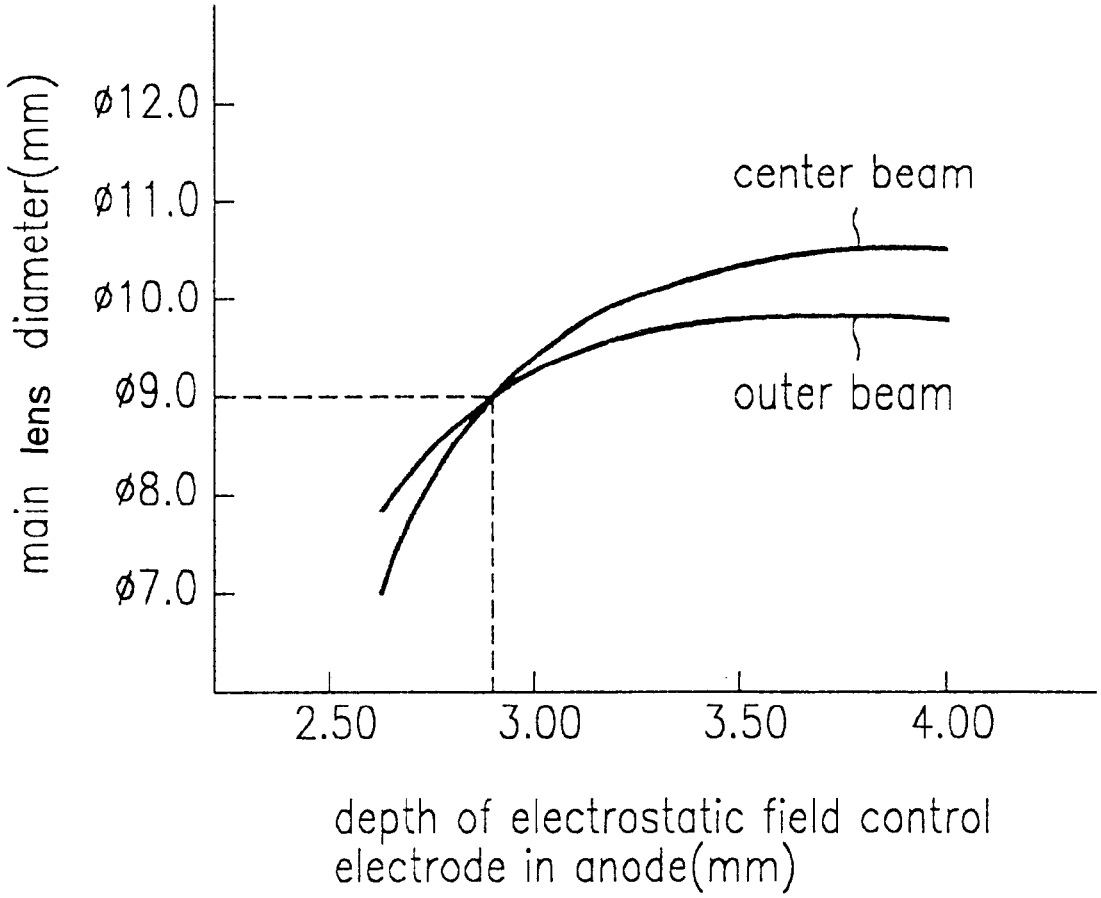
FIG. 13 illustrates a graph showing a main lens diameter and a depth of an electrostatic field control electrode.

The main lens diameter of the electron gun is limited by a neck diameter. As shown in FIG. 13, in general, when the neck diameter is 29.1 mm, the main lens diameter of the center electron beam is smaller than the outer electron beam when the lens diameter is smaller than approx. 9.0 mm, and the main lens diameter of the center electron beam is greater than the outer electron beam when the lens diameter is greater than approx. 9.0 mm.

As shown in Table 3 below, when the neck diameter is 24.4 mm, the main lens diameter of the center electron beam is smaller than the outer electron beam when the lens diameter is smaller than approx. 8.0 mm. And, when the neck diameter is 32.5 mm, the main lens diameter of the center electron beam is smaller than the outer electron beam when the lens diameter is smaller than approx. 10.2 mm.

TABLE 3

| | | | |
|---|---|---|---|
| Neck diameter (mm) | 24.3 | 29.1 | 32.5 |
| Main lens diameter (mm) | 8.0 | 9.0 | 10.2 |

Thus, a correlation of the neck diameter with the main lens diameter at which the center lens diameter becomes smaller than the outer lens diameter can be expressed by the following equation.

$$\text{Main lens diameter} \geqq (0.26 \times \text{neck diameter}) + 1.4$$

Figure 10:
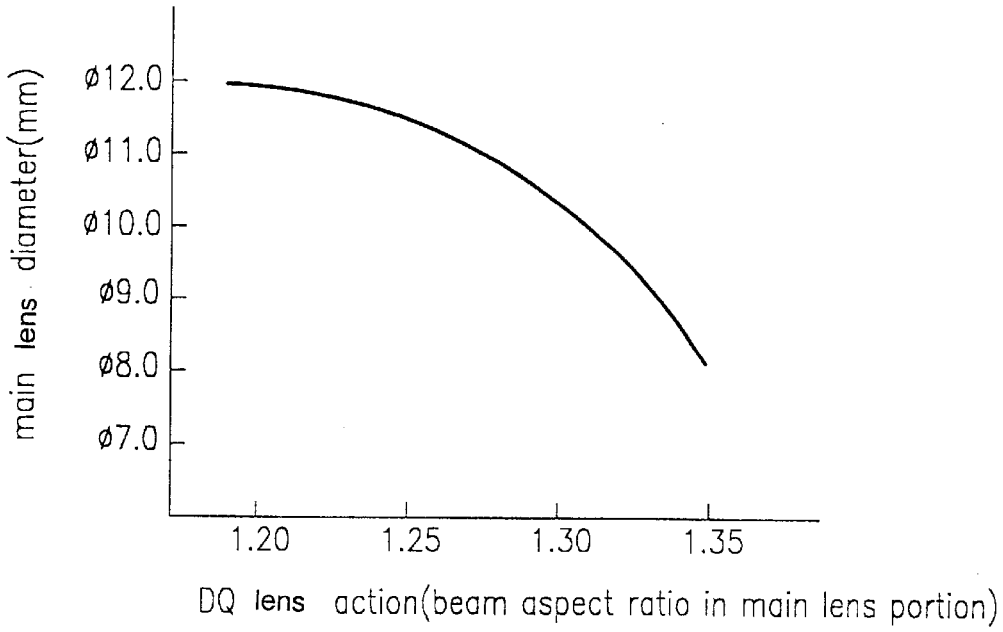
FIG.10 Related Art
FIG. 10 illustrates a graph showing correlation between a main lens diameter and a DQ lens action.
Figure 11:
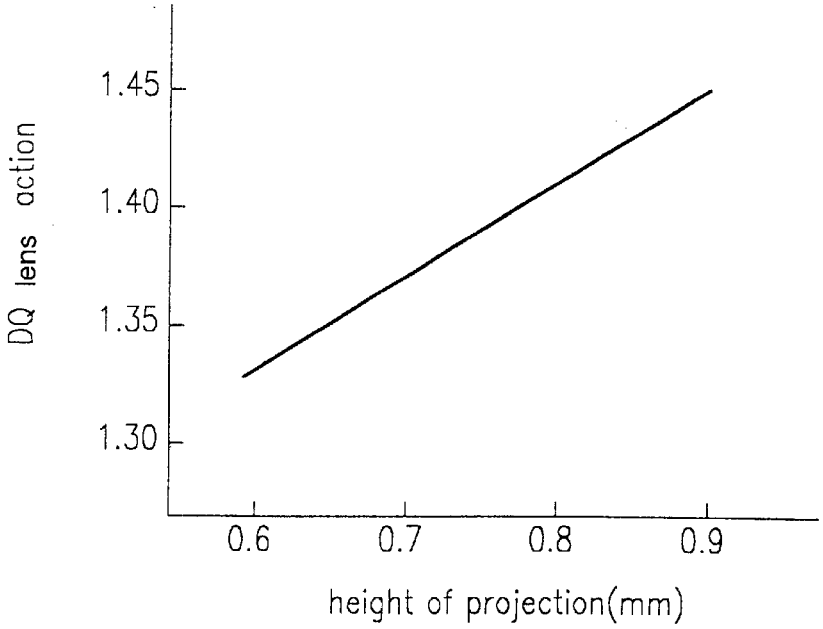
FIG.11 Related Art
FIG. 11 illustrates a graph showing correlation between a height of the plate projection on the fifth electrode and a DQ lens action.

According to the above equation, a DQ action of the center beam portion should be weaker than the DQ action of the outer beam portion. That is, according to FIG. 10 showing correlation between the main lens diameter and the DQ lens action, it can be known that the greater then main lens diameter, the weaker the DQ lens action. Therefore, in the case of a related art electron gun which has the center beam diameter smaller than the outer beam diameter, the DQ lens action for the center beam should be stronger than the outer beam.

Figure 14:
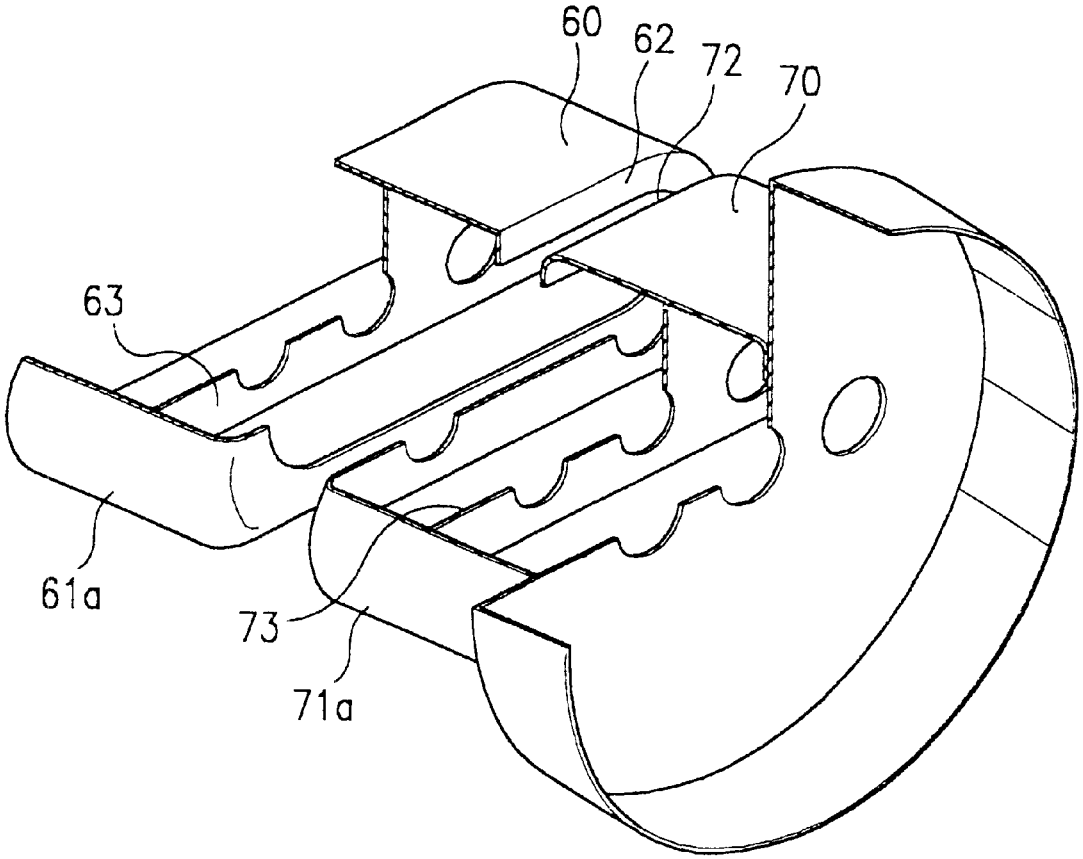
FIG. 14 illustrates a perspective view showing key parts of main lens forming electrodes in accordance with a second preferred embodiment of the present invention.

FIG. 14 illustrates a perspective view showing key parts of main lens forming electrodes in accordance with a second preferred embodiment of the present invention, including cup electrodes 61*a*, 71*a* having electrodes 60, 70 for forming main lens and rim portions 62, 72 for passing the three electron beams in common, and electrostatic control electrodes 63, 73 of inner electrode forms inside of the cup electrodes spaced away from the rim portions.

Figure 15:
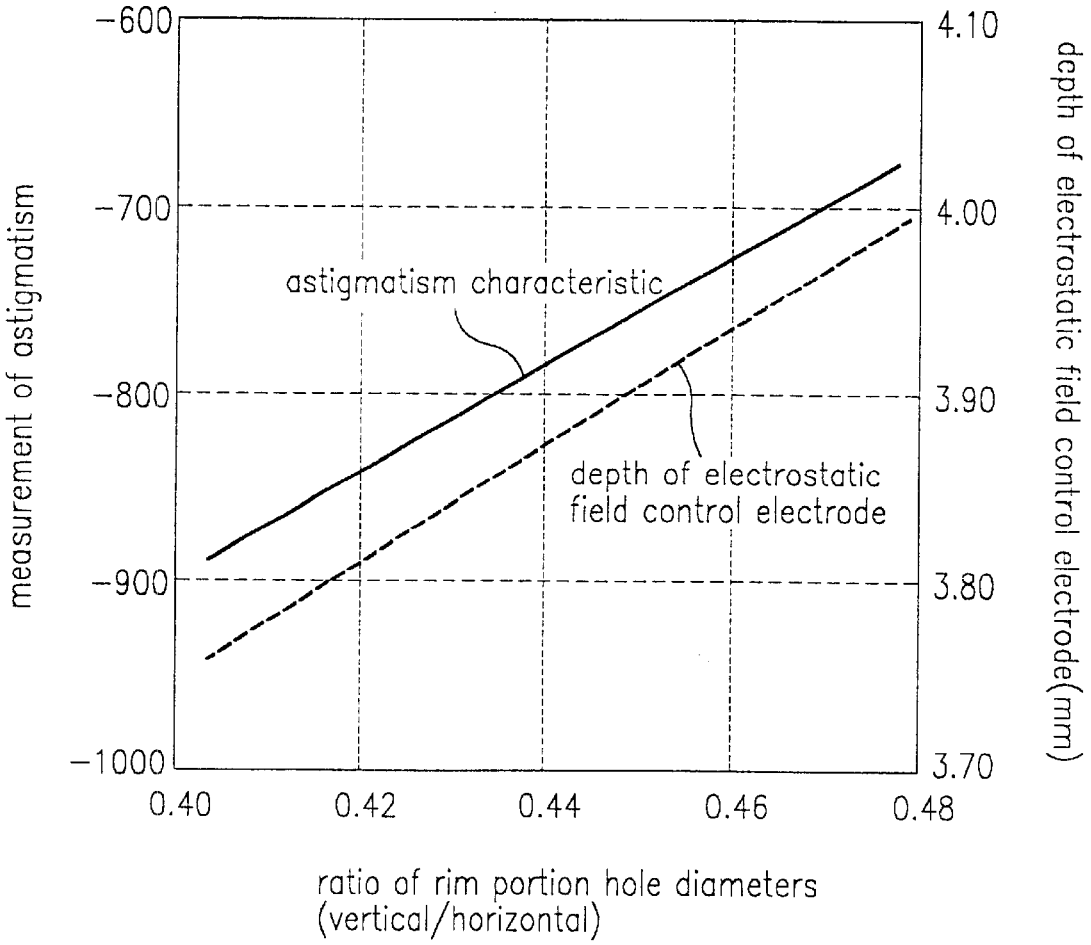
FIG. 15 illustrates a graph showing a correlation between a ratio of apertures in a rim portion and astigmatism characteristics; and, FIG. 16 illustrates a graph showing a depth of an electrostatic field control electrode fitted to main lens forming electrodes vs. a characteristic change.

FIG. 15 illustrates a graph showing a correlation between a ratio of apertures in a rim portion, astigmatism characteristics and depth of an electrostatic field control electrode.

Referring to FIG. 15, a ratio V/H of the maximum horizontal diameter H to the maximum vertical diameter V set greater than 0.45 provides an astigmatism characteristic of −750V, the depth of the electrostatic field control electrode 63, 73 can be set deeper. And, it is known that the ratio of the maximum horizontal diameter and the maximum vertical diameter of the rim portions 62, 72 and the depth of the minimum electrostatic control electrode 63, 73 which permits an optimal design of the main lens have the following relationship.

$$L \geqq (V/H) + 2.1$$

As distinguished from related art electron guns, since the ratio of V/H is designed to be greater than 0.45 while the depth of the electrostatic control electrode is designed deeper, it is essential than the depth of the electrostatic field control electrode 73 of the anode 70 should be designed deeper than the depth of the electrostatic field control electrode 63 of the focus electrode 60, which will be explained in detail.

In order to enlarge the diameter of the main lens, either the aperture diameters of the main lens forming electrodes 60, 70 must be enlarged physically, or positions of the electrostatic field control electrodes 63, 73 set deeper. In the present invention, in order to enlarge the main lens diameters, the aperture diameters of the main lens forming electrodes 60, 70 are enlarged physically, to have the maximum horizontal diameter of the rim portion greater than 19.2 mm, and the maximum vertical diameter of the rim portion greater than 8.7 mm.

TABLE 2

| | Aperture diameter of the rim portion (mm) | | Lens diameter (mm) | |
|---|---|---|---|---|
| No. | Horizontal | Vertical | Horizontal | Vertical |
| 1 | 18.0 | 7.0 | 8.00 | 7.20 |
| 2 | 19.0 | 8.0 | 8.80 | 7.80 |
| 3 | 19.6 | 9.2 | 9.40 | 8.20 |

TABLE 2 illustrates changes of the main lens diameter according to changes of the rim portions, wherein it can be known that, a rim portion in the related art having a horizontal diameter 19.0 mm and a vertical diameter 8.0 mm is enlarged to have a horizontal diameter 19.6 mm and a vertical diameter 9.2 mm in the present invention, a horizontal diameter of the main lens can be enlarged from 8.8 mm to 9.4 mm by approx. 7% where the depths of the electrostatic field control electrodes 63, 73 in the main lens portion are fixed to 3.5 mm for the focus electrode and 2.6 mm for the anode. And, setting the ratio of the maximum vertical diameter to the maximum horizontal diameter of the rim portions 62, 72 to be greater than 0.45 for enlargement of the main lens diameter by positioning the depth of the electrostatic field control electrode deeper, permits the rim portion that have no electrostatic field control electrode to have an astigmatism of −750 from −850 in the related art when the ratio is 0.42. That is, as shown in TABLE 1, the deeper the depth of the electrostatic field control electrode, the greater the diameter of the horizontal lens. According to TABLE 2, that reflects experimentation in which the maximum horizontal diameter of the main lens is set to be 19.0 and the maximum vertical diameter of the main lens is set to be 8.0 mm, if the depths of the electrostatic field control electrodes 63, 73 are set deeper while the apertures of the rim portions 62, 72 are formed greater, a significant effect of the horizontal diameter enlargement can be obtained.

Figure 16:
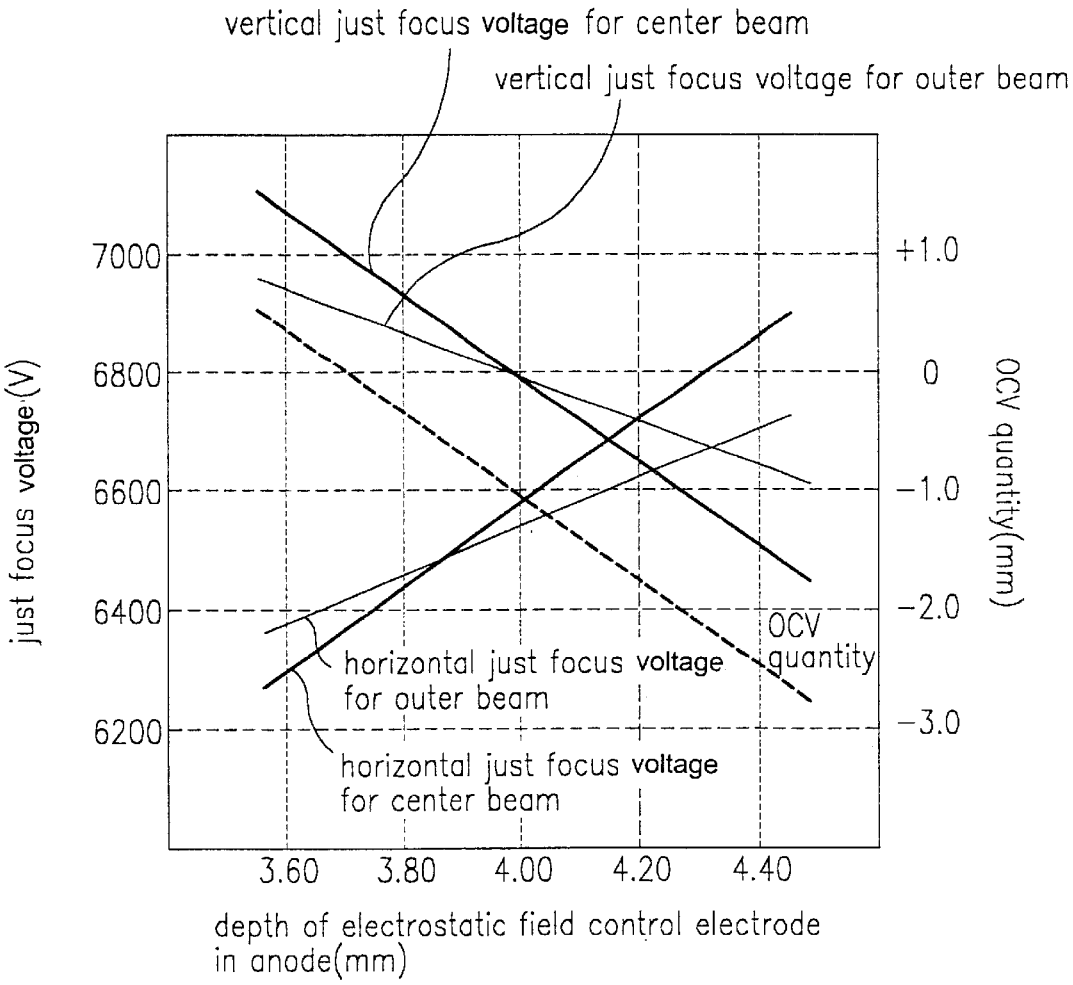

FIG. 16 illustrates the results of an experiment directed to a design of an optimal electrostatic field control electrode of an anode which compares the just focus voltage and OCV of the outer electron beam pass through aperture and the center electron beam pass through aperture while the ratio of the maximum vertical diameter to the maximum horizontal diameter of the rim portion is set to be 0.47, and the depth of the electrostatic field control electrode is set to be 4.0 mm. As can be known from the figure, a design value of the depth of the electrostatic field control electrode of the anode corresponding to an optimal value −2.5~−1.0 mm of an OCV at which a horizontal and vertical just focus voltages for the outer electron beam and the center electron beam are the same is 4.2 mm. Therefore, in the present invention, the depth of the electrostatic control electrode 73 of the anode 70 should be designed deeper than the depth of the electrostatic control electrode 63 of the focus electrode 60. This result is opposite to a result in the main lens in the related art electron gun. In the main lens structure of the electron gun of the present invention, the depth of the electrostatic field control electrode 73 of the anode 70 should be deeper than the depth of the electrostatic control electrode 63 of the focus electrode 60 for obtaining the same lens actions and optimal OCV for the three electron beams. And, as the rim portion aperture diameters and the electrostatic field control electrodes are formed deeper for enlargement of the main lens, the horizontal and vertical direction diameter of the center electron beam pass through aperture of the electrostatic field control electrode should be formed smaller than the outer electron beam pass through aperture, for maintaining convergence forces for the center electron beam and the outer electron beam the same.

Optimal design dimensions of the main lens in the electron gun of the present invention are as follows.

rim portions of the focus electrode and the anode: maximum horizontal diameter 19.6 mm, maximum vertical diameter 9.2 mm a ratio of a maximum vertical diameter to a maximum horizontal diameter of the rim portions: 0.468 depths of the electrostatic field control electrode: focus electrode 4.0 mm, anode 4.2 mm, center aperture diameter of the electrostatic field control electrode: focus electrode 5.5 mm, and anode 5.5 mm outer aperture diameter of the electrostatic field control electrode: focus electrode 5.5 mm, and anode 5.6 mm voltage: anode voltage 26.0 KV, and focus voltage 6700 V The main lens diameter of the present invention is 11.0 nm in the horizontal direction and 7.8 mm in the vertical direction. By enlarging a horizontal direction main lens diameter up to approx. 11.0 mm for reducing a horizontal diameter which give much influence to a focus, the present invention can obtain an effect of 25% enlargement compared to the related art main lens, thereby permitting to obtain a smaller spot diameter meeting to requirements for high resolution and high frequency. By providing a weaker DQ lens action for the center beam portion than the outer beam portion for compensating a difference between the center lens diameter and the outer lens diameter, excellent focus characteristics can be obtained all over the screen.

It will be apparent to those skilled in the art that various modifications and variations can be made in the electron gun for a color CRT of the present invention without departing from the spirit or scope of the invention. Thus, it is intended that the present invention cover the modifications and variations of this invention provided they come within the scope of the appended claims and their equivalents.

What is claimed is:

1. An electron gun for a color CRT, comprising:

a plurality of cathodes each for emitting an electron beam;

a triode unit having a control electrode and an accelerating electrode for controlling an amount of emission of each of the electron beams;

a pre-focus lens unit having at least two pre-focus lens electrodes for converging the electron beams;

two main lens electrodes collectively forming a main lens for focusing the electron beams onto a screen, each of the two main lens electrodes having (1) a rim portion on opposing surfaces, and (2) an electrostatic field control electrode positioned a distance from the rim portion, wherein, in the main lens electrodes, a depth from the rim portion of an anode to the electrostatic field control electrode is deeper than the depth from the rim portion of a cathode to the electrostatic field control electrode.

2. An electron gun for a color CRT, comprising:

a plurality of cathodes each for emitting an electron beam;

a triode unit having a control electrode and an accelerating electrode for controlling an amount of emission of each of the electron beams;

a pre-focus lens unit having at least two pre-focus lens electrodes for converging the electron beams;

two main lens electrodes collectively forming a main lens for focusing the electron beams onto a screen, each of the two main lens electrodes having (1) a cup electrode with a rim portion on opposing surfaces of respective main lens electrodes, (2) an electrostatic field control electrode positioned a distance inside from the rim portion having three electron beam pass through apertures, and (3) an electrode of a cap form, three of them being connected electrically, wherein, in the main lens electrodes, relations between a maximum horizontal diameter H and a maximum vertical diameter V of the three electron beam pass through apertures, and a distance from the rim portion to the electrostatic field control electrode L for at least one of the electrodes can be expressed as follows:

$$L \geqq 4.0(V/H)+2.1.$$

3. An electron gun as claimed in claim 1, wherein, in the main lens electrodes, a ratio V/H of a maximum vertical diameter V to a maximum horizontal diameter H of said electron beam pass through apertures of at least one of the main lens electrodes is set to be $V/H \geqq 0.45$.

4. An electron gun as claimed in claim 2, wherein, in the main lens electrodes, a ratio V/H of a maximum vertical diameter V to a maximum horizontal diameter H of said electron beam pass through apertures of at least one of the main lens electrodes is set to be $V/H \geqq 0.45$.

5. An electron gun as claimed in claim 1, wherein the horizontal and vertical diameters of the center electron beam pass through apertures formed in the electrostatic field control electrode of each of the main lens electrodes are smaller than the horizontal and vertical diameters of the outer electron beam pass through apertures.

6. An electron gun as claimed in claim 2, wherein the horizontal and vertical diameters of the center electron beam pass through apertures formed in the electrostatic field control electrode of each of the main lens electrodes are smaller than the horizontal and vertical diameters of the outer electron beam pass through apertures.

7. An electron gun as claimed in claim 5, wherein the center electron beam pass through apertures of the electrostatic field control electrode in each of the main lens electrodes is circular.

8. An electron gun for a color CRT, comprising:

a plurality of cathodes each for emitting an electron beam;

a triode unit having a control electrode and an accelerating electrode for controlling an amount of emission of each of the electron beams;

a pre-focus lens unit having at least two pre-focus lens electrodes for converging the electron beams;

a dynamic quadrupole lens unit ("DQ lens unit") having at least two electrodes for removing a vertical halo from a screen;

two main lens electrodes collectively forming a main lens for focusing the electron beams onto the screen, the main lens has a relation expressed as follows, a diameter of the main lens $\geqq$(neck diameter$\times$0.26)+1.4, wherein a DQ lens action of a center beam portion formed by the DQ lens unit is weaker than the DQ lens action of an outer electron beam portion.

9. An electron gun as claimed in claim 8, wherein each of the main lens electrodes includes;

a rim portion with a common aperture for each of three electron beams in a surface opposing the other respective main lens electrode, and an electrostatic field control electrode fixed to the main lens electrode at a position spaced away from the rim portion.

10. An electron gun as claimed in claim 9, wherein relations between a maximum horizontal diameter H and a maximum vertical diameter V of the common aperture, and a distance from the rim portion to the electrostatic field control electrode L can be expressed as follows:

$$L \geqq 4.0(V/H)+2.1.$$

11. An electron gun as claimed in claim 8, wherein an electrode for forming the DQ lens unit includes;

an electrode having an electron beam pass through aperture of a vertically elongated key aperture form, and horizontal plate projections around the electron beam pass through aperture, a height of the plate projection on the center electron beam portion being lower than the height of the plate projection on the outer electron beam portion.

* * * * *